US007543775B2

(12) United States Patent
Benvenuti et al.

(10) Patent No.: US 7,543,775 B2
(45) Date of Patent: Jun. 9, 2009

(54) PLANT FOR HANDLING REELS OF PAPER OR SIMILAR AND FOR CONVERTING THEREOF AND CARRIAGE FOR HANDLING SAID REELS

(75) Inventors: Angelo Benvenuti, Lucca (IT); Valter Di Nardo, Lucca (IT); Gabriele Erasmo Pacini, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 398 days.

(21) Appl. No.: 10/581,298

(22) PCT Filed: Nov. 29, 2004

(86) PCT No.: PCT/IT2004/000661

§ 371 (c)(1),
(2), (4) Date: Jun. 1, 2006

(87) PCT Pub. No.: WO2005/054100

PCT Pub. Date: Jun. 16, 2005

(65) Prior Publication Data

US 2007/0108336 A1 May 17, 2007

(30) Foreign Application Priority Data

Dec. 2, 2003 (IT) ..... FI2003A0303

(51) Int. Cl.
*B65H 19/00* (2006.01)

(52) U.S. Cl. ..... 242/559; 242/533; 242/559.3; 414/911

(58) Field of Classification Search ..... 242/559, 242/533, 559.3; 414/911
See application file for complete search history.

(56) References Cited

U.S. PATENT DOCUMENTS

| | | | | |
|---|---|---|---|---|
| 3,276,711 | A | 10/1966 | Martin | |
| 3,753,833 | A * | 8/1973 | Bassett et al. | 156/504 |
| 5,730,389 | A | 3/1998 | Biagiotti | |
| 5,893,530 | A * | 4/1999 | Alexander et al. | 242/559 |
| 6,039,284 | A * | 3/2000 | Lehrieder et al. | 242/559 |
| 6,138,938 | A * | 10/2000 | Lehrieder et al. | 242/559.3 |
| 6,155,516 | A * | 12/2000 | Lehrieder et al. | 242/559.3 |
| 6,679,451 | B1 * | 1/2004 | Biagiotti | 242/559 |
| 6,820,837 | B2 * | 11/2004 | Long | 242/554.2 |
| 6,948,901 | B2 * | 9/2005 | Allemann | 414/279 |

FOREIGN PATENT DOCUMENTS

| | | |
|---|---|---|
| EP | 1 136 406 A2 | 9/2001 |
| IT | FI 1987A0009474 | 1/1990 |
| WO | WO 00/56644 | 9/2000 |

OTHER PUBLICATIONS

Nakajima Seiji: Patent Abstracts of Japan, vol. 1995, No. 09, Oct. 31, 1995 and JP 07-157155 A, Jun. 20, 1995; Hymex:KK.

* cited by examiner

*Primary Examiner*—Sang Kim
(74) *Attorney, Agent, or Firm*—Breiner & Breiner, LLC

(57) ABSTRACT

The plant comprises in combination at least one winder (3) which receives at least one web material and produces large diameter reels (B) by winding said web material around winding mandrels (M); at least one unwinder (9) which unwinds said large diameter reels (B) and feeds the web material to a transformation line (15, 21, 23); a plurality of carriages (11), which transfer said reels from a loading station (7) towards said unwinder (9), support said reels in the unwinder during unwinding and convey the finished mandrels towards a recovery area.

42 Claims, 6 Drawing Sheets

PLANT FOR HANDLING REELS OF PAPER OR SIMILAR AND FOR CONVERTING THEREOF AND CARRIAGE FOR HANDLING SAID REELS

TECHNICAL FIELD

The present invention concerns a plant for the production of web material items, in particular large or small logs of paper such as tissue paper or similar.

The invention also concerns a carriage particularly suitable for use in said plants.

STATE OF THE ART

For the production of tissue paper items, such as toilet rolls, rolls of cleaning paper for domestic and industrial use, serviettes and paper handkerchiefs and similar, the paper ply is usually produced by a continuous machine, in which a mixture comprising cellulose fibers and water is distributed on a forming wire or felt and, in successive stages, is dried until forming a ply of sufficiently coherent cellulose fibers. One single ply or in some cases even two or more plies obtained as above are continuously wound, at the outlet of the forming machine, on large diameter reels. The latter typically have diameters in the order of 2-3 m, axial lengths of 2-6 m and weights in the order of 1000-7000 kg. They are produced by means of winders.

In some cases the paper ply is produced by means of so called dry forming or air laid techniques. In said techniques, the cellulose fibers are suspended in a gaseous flow (typically air) and via suction deposited in a thin uniform layer on a forming wire. Suitable techniques are used to obtain cohesion of the fibers. The ply is then wound on large diameter reels.

Whatever technique is used to form the reels, after production thereof in the winders, around winding axes or mandrels, the latter are extracted from the reels and the reels are normally transferred to a separate production department, or even to a different factory from the one that produced them, to be unwound and used.

In the production of toilet rolls, in particular, the large reels of paper are inserted in unwinders which feed one or more reels simultaneously to a converting line comprising at least one rewinder, which provides for winding of limited quantities of paper on winding cores, to form logs or rolls with diameter equal to the finished product, but with length equal to a multiple of the logs intended for sale. Subsequent cutting or cropping operations produce the finished rolls which are packaged.

The Italian patent no. 1.213.819 describes a system for the insertion and replacement of large diameter reels in unwinders for feeding a rewinder forming part of a converting line. U.S. Pat. No. 5,730,389 describes a further system for insertion of reels into an unwinder and automatic joining of a ply of a reel which is finishing to a ply of a new reel. Carriages are also described which each support two reels, one in the unwinding phase and the other waiting. Translation of the carriage parallel to the axis of the reels in one direction or the other permits replacement of a finished reel with a new reel. The reels are positioned on the carriage by means of an overhead crane or other conventional means, taking them from a storage area.

The production plants currently known involve heavy-duty handling, transfer and transport of the reels, also due to the high incidence of labor and the large spaces required.

Furthermore, the reels of web material are stored in storage areas where they remain in stock also for relatively long periods, even several days. This involves considerable drawbacks, not only from the logistical point of view but also in strictly technical terms. In fact, the characteristics of the paper that forms the reels alter over time. In particular, uneven distribution of the humidity content and deformation of the reels occur, in particular if the latter are kept in a horizontal position. According to the position in which said reels are stored, phenomena of deformation, ovalization and telescoping can also occur, in addition to reduction of the volume of the ply and more generally loss or reduction of a part of the optimal characteristics obtained during the ply production phase.

A further drawback of the traditional reel management plants consists in the fact that any defects in the material are identified only a fairly long time after production, consequently making it impossible to promptly intervene in the production phase to correct the production parameters and resulting, for example, in the manufacture of excessively fragile paper. This involves production losses and other drawbacks known to persons skilled in the art.

OBJECTS AND SUMMARY OF THE INVENTION

According to a first aspect, the object of the invention is to produce a plant with simpler construction and management with respect to the traditional plants and which solves or reduces one or more of the above-mentioned drawbacks.

According to a different aspect, object of the invention is the production of a carriage with a configuration designed in particular to be used in a plant of the above type, but which could also have different uses.

Substantially, according to a first aspect, the invention provides for a plant for the production of logs of web material, comprising in combination at least: a winder which receives at least one web material and produces large diameter reels by winding said web material around winding mandrels or axes; an unwinder which unwinds said large diameter reels and feeds the web material to a rewinding machine which produces logs of web material of smaller diameter with respect to said reels; a plurality of carriages which transfer said reels from a loading station to said unwinder, support them during unwinding and convey the axes or mandrels back to the winder area.

Substantially, the invention permits the creation of a complete continuous system which from the machine producing the paper ply permits logs or rolls or even the small finished rolls ready for packaging to be obtained. The plant can also be completed with packaging lines. In the entire plant human intervention is reduced to a minimum and relegated to the performance of secondary operations such as preparation of the initial edge of the ply of the various reels, cleaning of the mandrels or axes with removal of the remains of paper and management of the intermediate storage area. Unlike traditional plants, once the reel has formed around the mandrel or axis of the winder, it remains connected to the axis, i.e. the mandrel is not removed from the reel. It is used to support the reel on the carriage on which it is immediately positioned and which moves the reel inside the unwinder, supports it during unwinding and furthermore conveys the finished axis or mandrel (or the non-usable faulty reel) back to the unwinder area.

With a plant of this type the reels that have just formed at the outlet of the continuous paper production machine are immediately directed to the user machine, i.e. to the rewinder, considerably simplifying the plant, reducing transport and handling costs and also saving on labor.

According to a particularly advantageous embodiment of the invention, a device is provided for transferring the reels from the winder to the carriages; said transfer device can consist of a conveyor, for example also a simple rolling guide. Since the winder axes or mandrels are provided, at the ends protruding from the reel, with bushes fitted idle on the axis, by resting these bushes on guides it is possible to obtain transfer of the reels without the latter having to roll. From the transfer device the reels are individually loaded on the carriages, without the need to use an overhead crane for loading.

According to an advantageous embodiment, the plant can comprise a "parking" area for reels produced by the winder, when the unwinder is not able to receive said reels. This can happen for example if the rewinder has stopped for any reason. In this way a sort of reservoir is created in which the reels are accumulated when the rate at which the reels are produced by the winder is higher than the consumption speed of the unwinder. Vice versa, the reels are taken from the storage area when the speed of the unwinder exceeds that of the winder. The plant is controlled to prevent the reels remaining too long in the parking area.

This makes it easier to couple the paper reel production section with the transformation section. For optimal management of the plant, the rewinder can work typically at two separate production speeds, one lower normal operating speed and one higher transitory speed. It is set to the higher speed after a pause or slowing down which has led to accumulation of material in the parking area, thus making up for production. Slight oversizing of the section comprising the rewinder and the stations downstream of the converting line provides a plant with a high level of automation and without storage area or in any case with a much smaller storage area.

Since transfer from and to the storage area is not a very frequent operation, loading and unloading of the reels on and from the carriage can be performed, in this case, by means of a traditional overhead crane system, controlled by the operator as usual. It is also possible, however, for a rolling guide to be provided in this storage area along which the reels are rolled. If the guide is slanting, individual carriages can unload the reels to be deposited in the storage area at one end of the guide and—if necessary—collect them from the opposite end. This avoids the use of an overhead crane also in this area and simple transfer of the carriages from one end to the other of the storage area guide permits simple and easy-to-automate plant handling also in this section.

The movement of the carriages, in fact, can be easily controlled and managed by means of a laser guide system, by means of a guided wire or other technique known to persons skilled in the art. A central unit controls the movements of the carriages and the speeds of the production and converting plant, in addition to the speeds of the individual machines in the line.

According to a different aspect, the invention also concerns a carriage for supporting the reels of web material wound on mandrels, comprising a rolling track for said mandrels and a mandrel locking device to retain the mandrels with the reels formed on them in a position along said rolling track. The carriages thus produced are particularly advantageous for use in a plant of the above type. In fact, both loading of the full reels coming for example from an accumulation guide running from the winder to a loading position, and unloading of the empty or partially empty mandrels is particularly easy. Any slanting of the rolling track facilitates movement of the mandrels and reels on the carriage.

The carriages thus produced, however, can also be used in different systems and applications from those described here.

In an advantageous embodiment, the device for locking the mandrel on the carriage comprises, for each end of the mandrels, a lever mechanism defining a seat for housing and retaining the corresponding end of the mandrel, and an actuator to lock and release the mandrels by means of said lever mechanism.

The lever mechanism can advantageously comprise a member defining the engagement seat of the end of the mandrel, supported by an oscillating lever and a pair of levers hinged together at one end, one of said levers being hinged to the carriage and the other being hinged to said member defining said seat. The two hinged levers form a sort of toggle. At the hinge point of the two levers an actuator is advantageously linked, for example and advantageously a cylinder-piston hydraulic actuator and more in particular a twin cylinder-piston actuator which serves to identify the work positions (i.e. waiting for the new reel, retention and unwinding of the reel and unloading of the mandrel of a finished reel), while an independent shock absorber absorbs the shocks during the loading operations for the purposes which will be clarified subsequently. The actuator determines opening and closing of the pair of levers. This opening and closing causes oscillation of the oscillating lever and an oscillation and/or translation movement of the member defining the seat housing and retaining the end of the mandrel. This serves to perform the following various functions: receiving the reel in the retaining seat; raising the seat above the rolling track of the mandrel on the carriage to retain the reel during transfer via the carriage and during unwinding; lowering said seat below the rolling track to unload the finished mandrel from the carriage.

According to a particularly advantageous embodiment of the invention, the oscillating lever and the pair of hinged levers are positioned so that the impact of a mandrel against the seat designed to engage it causes the member defining the seat to be raised. In this way the kinetic energy of the reel wound on the mandrel is transformed at least partly into potential energy, due to the fact that the connections formed by the levers raise the reel at the expense of its kinetic energy. This reduces the stress on the structure of the carriage and is particularly advantageous in view of the considerable weight of the reels used for the production of rolls of tissue paper.

Further advantageous characteristics and embodiments of the invention are indicated in the appended dependent claims.

BRIEF DESCRIPTION OF THE DRAWINGS

The invention will be better understood by following the description and the attached drawing, which shows a non-limiting practical embodiment of the invention. More in particular, in the drawing.

DETAILED DESCRIPTION OF THE PREFERRED EMBODIMENT OF THE INVENTION

Figure 1:
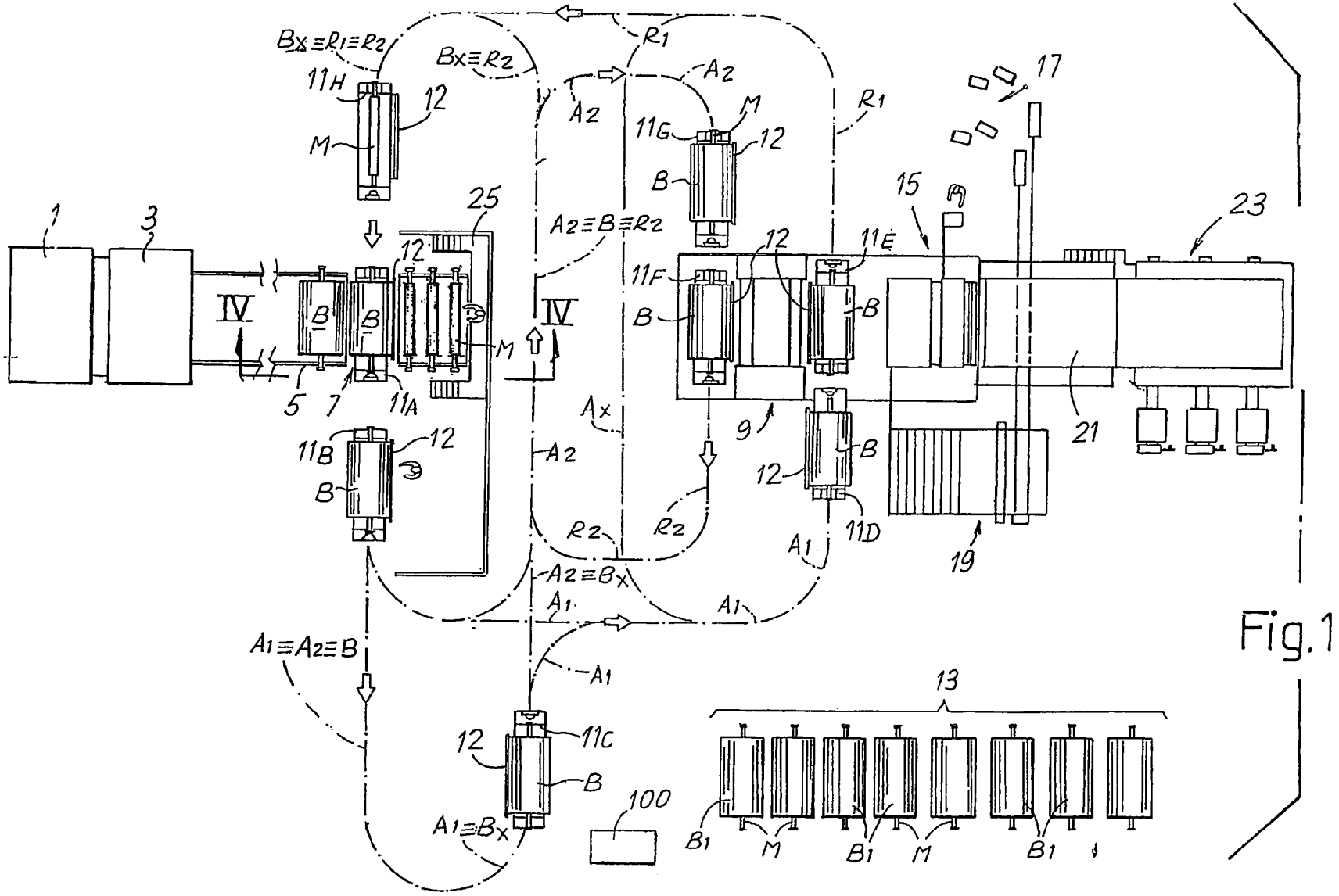
FIG. 1 shows a plan view of the plant layout.
Figure 2:
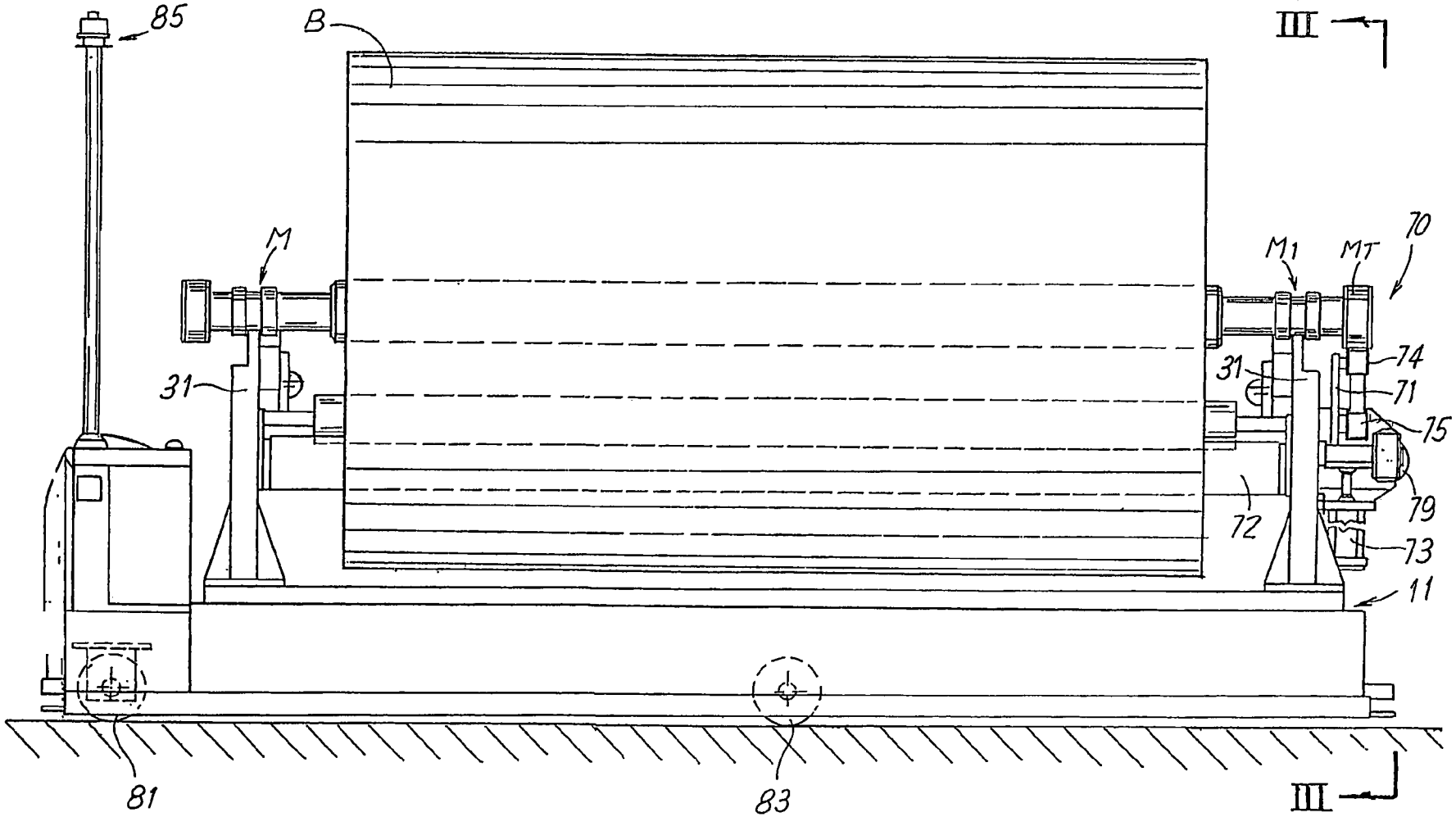
FIG. 2 shows a lateral view of the carriage.
Figure 4:
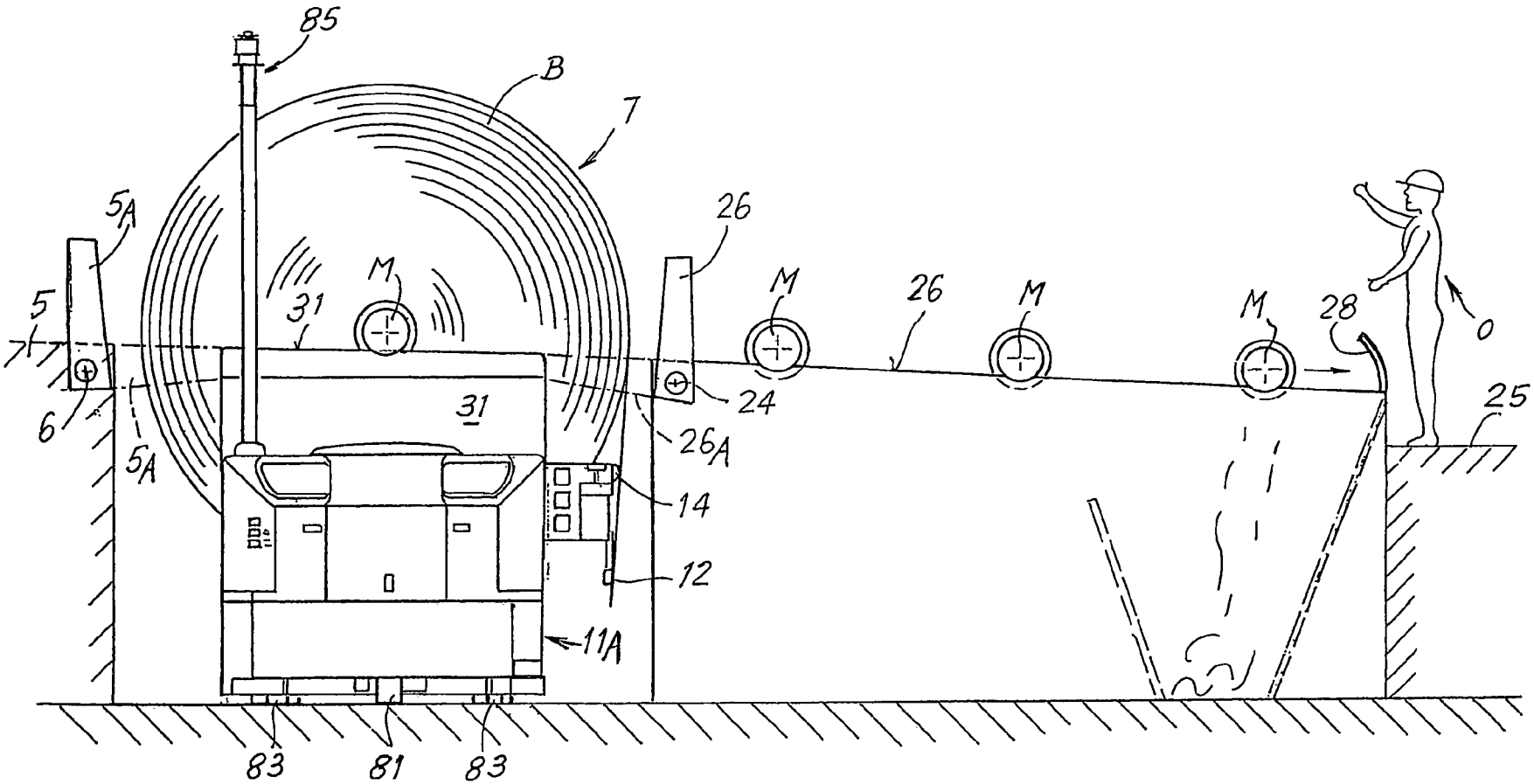
FIG. 4 shows a section according to IV-IV of FIG. 1.

FIG. 1 schematically shows the layout of the plant according to the invention. Reference 1 schematically and generally indicates a continuous machine for the production of one or more plies of tissue paper. The ply is wound by a winder schematically indicated by 3, positioned downstream of the continuous machine 1. The reels B produced by the winder are arranged on a conveying guide 5, on which more than one reel with the winding axis or mandrel of the winder 3 inside it can be positioned. The guide 5 terminates in a station 7 for loading the reels on respective carriages for conveying the reel to an unwinder 9 positioned downstream. In FIG. 4, showing a lateral view of the loading station 7, 5A indicates movable portions of the guide 5, hinged around oscillation axes 6, which can assume two positions, lowered and raised respectively. In the lowered position, the portions 5A form a continuation of the guide 5 which extends as far as the carriage 11A located in the station 7, to permit rolling of a reel right up to the carriage. The raised position allows the carriage 11, loaded with the reel B, to move out.

The diagram of FIG. 1 shows eight positions for the carriages 11, marked by 11A, 11B, . . . 11H. In practice a lower number of carriages 11 will be sufficient, typically six carriages. The carriage 11A, with one of the reels B produced by the winder 3, is positioned in the loading station 7. At the outlet of the loading station 7 a carriage is shown in position 11B, on which there is a reel B previously loaded on the carriage. In this position an operator can prepare the free initial edge of the web material, in a per se known manner, for subsequent joining to a terminal edge of a reel that is finishing.

Reference 11C indicates a carriage loading and unloading auxiliary position, in front of an accumulation or waiting area 13, in which there is a plurality of reels B1 waiting to be sent to the unwinder 9. As will appear clear from the following description, the reels B1 produced by the winder 3 in excess with respect to the reels which the unwinder 9 is able to process, for example due to a temporary reduction in production speed or a temporary blockage in the transformation line, are sent to the accumulation area 13 and remain waiting there (for a relatively short time).

In the unwinder 9 there are two carriages 11E, 11F, in which respective reels previously loaded in them are still positioned, for example in the loading station 7 or in position 11C. The reels B supported by the carriages in position 11E, 11F are both in the unwinding phase, since the unwinder simultaneously feeds two plies of web material to the transformation line downstream of it. The two plies are joined to form a multilayer web material.

Outside the unwinder 12, beside the carriages in position 11E and 11F, respective carriages 11D and 11G are waiting, with respective reels B supported on them. When the reel on the carriage 11E finishes, the carriage 11E translates parallel to the axis of the reel to leave the unwinder while the carriage 11D enters the unwinder. Per se known systems described for example in U.S. Pat. No. 5,730,389 are used to interrupt the web material coming from the finished reel and join the free final edge produced to the free initial edge of the reel of the carriage 11D, previously prepared by the operator in position 11B. Analogously the carriage in position 11F is replaced with the carriage in position 11G when the reel supported by the first of them finishes.

The line downstream of the unwinder comprises (in a per se known manner) in the example illustrated a rewinder 15 which produces, starting from the web material delivered by the reels in the delivery phase in the unwinder, logs or rolls of axial length equal to the width of the plies produced by the continuous machine 1 and with diameter equal to the diameter of the finished product. The logs are wound on tubular cardboard cores produced by core winders 17, which produce tubular cores that temporarily accumulate in a lateral accumulator 19 and are then fed in sequence to the rewinder 15.

Downstream of the rewinder a log accumulator 21 and a cutting station 23 are positioned, in which the logs are cut into smaller units of the required axial length.

The machinery of the various stations 9, 15, 17, 19, 21, 23 is known per se and does not require description here. In particular, the unwinder can be produced as described for example in U.S. Pat. No. 5,730,389, the content of which is incorporated in the present description. Said publication also describes in detail an embodiment of the systems that retain the free initial edge of each reel and which ensure automatic adhesion of said initial edge to the final edge of a reel that is finishing.

The carriages 11 loaded with the reels B coming out of the loading station 7 can follow three alternative paths, described below. According to a first path, the carriages can be inserted in a first position inside the unwinder. In the configuration shown in FIG. 1, this first position is assumed by the carriage 11E. The path which the carriages must follow each time to reach the position of carriage 11E is indicated by A1. The carriage 11D is in the terminal area of this path, immediately before insertion in the unwinder.

The second path is followed, by carriages 11 which have to reach a second position in the unwinder 9, a position assumed in the set-up shown in FIG. 1 by the carriage 11F. This path is indicated by A2 in FIG. 1. The carriage 11C is in the terminal portion of this path, immediately before being inserted in the unwinder 9.

As can be observed in the drawing, the carriages 11E and 11F are positioned in the opposite direction when they are in the unwinder 9. This is because in the unwinder the free initial edges of the reels B supported by the carriages to positions 11E, 11F must be facing each other, i.e. towards the intermediate area or center line of the unwinder. On the various carriages, a suction bar which retains the free edge of the respective reel is schematically indicated by 12. As can be observed in FIG. 1, the bars 12 of the carriages 11E, 11F are facing each other. To assume this reciprocal position, the carriages that follow the path A1 are rotated 180° around a vertical axis.

The third path, indicated by Bx, is followed by the carriages 11, the reels B of which must be unloaded in the accumulation or waiting area 13. The carriages that follow this path stop temporarily in the position of carriage 11C to allow suitable movement equipment, typically an overhead crane, to withdraw the reel B which is on the carriage in this position. The reel will then be placed in area 13 by the same movement equipment. The carriage that has stopped in position 11C and which is therefore empty, proceeds along path B until it re-positions in the loading station 7.

It can be seen from the layout of FIG. 1 that it is possible, by bringing an empty carriage to position 11C, to load on it one of the reels parked in area 13 and move said carriage along the path A1 or along the path A2 alternatively in one or the other of the positions 11E and 11F in the unwinder 9. In practice, the reels formed by the winder 3 are conveyed to area 13 when they are not absorbed at the same rate as the unwinder. This can happen, for example, due to a slowing down or blockage of the line from the unwinder 9 in a downstream direction. These reels are re-introduced into the process when the rate of the unwinder increases and exceeds the production rate of the winder.

In the layout described here, release of the reels B from the carriage 11 and subsequent withdrawal from the area 13 on the carriage 11 is performed by always bringing the carriage, to the same position 11C with the movement performed by an overhead crane or other suitable handling mechanism. However, it is also possible to provide rolling tracks in area 13 analogous to the tracks forming the conveyor 5 with release of the reels at one end of the tracks, while withdrawal and deposit on an empty carriage takes place at the opposite end. In said case a path will be provided for conveying the carriages 11 to the opposite end of the accumulation area, at a lower level, so that the reels can be again loaded on the carriage by gravity and exploiting the locking mechanism, described below, which is used also in the station 7 to block the reels which reach the conveying track 5 by gravity.

Ax indicates an auxiliary path which allows a carriage in position 11E to leave the unwinder and return to it. This may be necessary for example in the case of breakage of the material wound on the reel B, still not finished, supported by the carriage.

The movement of the carriages is controlled advantageously via a laser guide system, by means of receivers arranged on the various carriages and emitters arranged in appropriate positions in the plant. Other automatic guide systems are possible. The automatic movement technology of the carriages is known per se to persons skilled in the art and is not described here in further detail. Movement of the carriages and in general the functions of the plant, comprising control of the speeds of the various machines, are controlled by a central unit schematically indicated by 100 in FIG. 1.

The reels B are wound on winding mandrels M, via which they are supported (as will be described in detail below) on the respective carriages. These mandrels must be recovered and recycled to the winder 3. For said purpose, the carriages which support the mandrels of finished reels return to the station 7. For said purpose, the carriages that have been sent to the unwinder along path A1 return to the station 7 along a path R1. This partially overlaps the path B described above.

The carriages with the finished reels coming from position 11F return towards the station 7 along a return path R2, which partly overlaps the paths A2 and B and partly the path R1. The carriage 11H is in the common section of the paths R1, R2 and B, immediately upstream of the loading position 7. On it an empty mandrel M is shown, i.e. without reel B, the latter having been entirely unwound in the unwinder 9.

The carriages that reach the position 7 can be provided with a mandrel M, or be completely empty. The latter possibility occurs when the carriage has passed from position 11C and the reel B on it has been transferred to area 13.

The finished mandrels M which arrive at the station 7 must be cleaned to eliminate any remains of web material. For said purpose, in station 7 a platform 25 is provided for an operator O (see in particular also FIG. 4), who performs said operation. The mandrels unloaded by the carriage which is in station 7 roll on a guide 26 as far as a stop 28 near the platform 25, which blocks the mandrels and protects the operator. "Parking" seats are provided along the guide 26 for the mandrels, so that several mandrels can be waiting along the guide. Members known per se and not shown serve to expel the mandrels from the housings each time to direct them towards the operator.

Transfer of the finished mandrel M from the carriage 11 to the guide 26 is performed by means of portions 26A of the guide 26 oscillating around a horizontal axis 24. This allows the portions 26A to align with the supporting surface of the mandrel on the carriage 11 in the station 7 to permit unloading of the mandrel M and in a raised position which permits passage of the carriage 11 with a new reel B resting on it.

On the carriages 11 a roller 14 (see also FIG. 3) is provided, which serves to guide the ply which unwinds from the reel when the diameter of the latter is reduced. The roller 14 also serves to limit the maximum diameter of the reels that can be unloaded towards the guide 26. For example said diameter limit can be set to 1.5 m. The plant must provide for the possibility of recovering faulty reels that cannot be used, or are partially non-usable. When a reel is entirely or partially non-usable, it is conveyed back—by the same carriage 11 that withdrew it from the station 7—to the station 7. If most of the reel has been used, the remains with the winding mandrel or axis M are unloaded along the guide 26 and the operator will manually remove the material still wound on it. If, vice versa, the quantity of material exceeds a certain limit, the reel is not unloaded towards the operator but withdrawn by the latter by means of an overhead crane and transferred to the disposal area.

The cleaned mandrels are transferred by means of an overhead crane or other suitable handling equipment to the winder 3.

Each carriage 11 is provided with a device for loading, locking in position and unloading of the reels B and mandrels M. This device will be described in its structure and function with reference to FIGS. 5 to 8, which show a lateral view of a side of any one of the carriages 11. An analogous device is provided on the opposite side.

The two sides of the carriage 11, one of which can be seen in FIG. 5 to 9 and is marked by 31, form with their upper edge 31A a rolling track for rolling of the ends of the mandrels M which protrude from the reels B wound on them. These edges align, in the loading station 7, with the movable parts 5A and 26A of the guides 5 and 26 referred to above.

Figure 9:
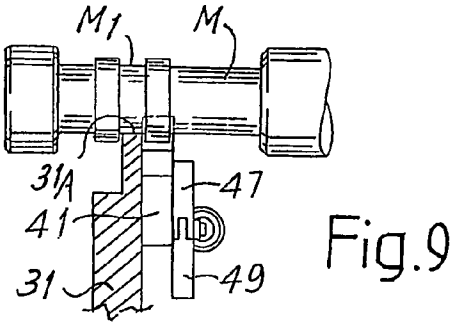
FIG. 9 shows a view according to IX-IX of FIG. 1 of an end of a mandrel on the respective rolling track.
Figure 8:
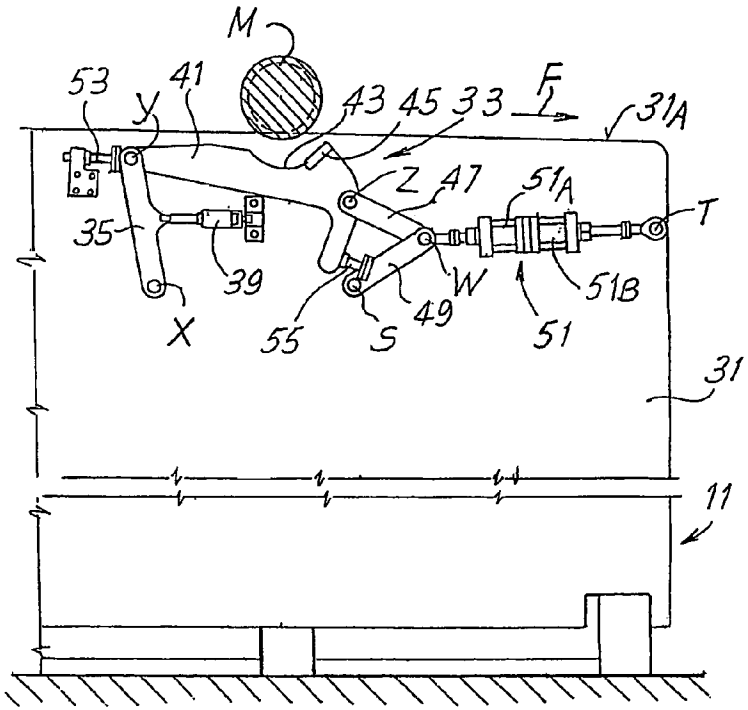

Each end of the mandrels M has (as can be seen in FIG. 9) a ring-shaped groove M1 which forms a guide for the edge 31A of the corresponding side 31 of the carriage. The edges 31A slant from the top downwards from left to right in FIGS. 5 to 8. Consequently, the mandrels, with the reels formed on them, which are rested on the tracks formed by the edges 31A of the side, roll in the direction of the arrow F due to the effect of their own weight.

Each side 31 is combined with a lever mechanism indicated overall by 33. This mechanism comprises a first lever 35 oscillating around an axis X and hinged in an intermediate position to a first end of a shock absorber 39, in turn hinged at its second end to a fixed point with respect to the side 31. A spring combined in parallel with the shock absorber 39 pushes the oscillating lever 35 against a stop 53.

The opposite end of the oscillating lever 35 with respect to the axis X is hinged around an axis Y to a member 41 forming a seat 43 for the end of the mandrel M. The seat 43 has a coating of elastic material 45 to dampen the shock of the mandrel which is rolled on the track formed by the edges 31A of the sides 31.

The member 41 is hinged, around an axis Z, to one end of a first lever 47 of a pair of levers 47, 49, hinged together in W. The second end of the lever 49 is hinged in S to the side 31. At the hinge axis W between the levers 47 and 49 a twin cylinder-piston actuator 51 is connected, in turn hinged in T to the side 31. In practice the actuator 51 is formed by two hydraulic cylinder-piston systems 51A and 51B for the purposes described herein. The unit formed by the pair of levers 47, 49 and by the actuator 51 constitutes a sort of toggle.

The member 41 co-operates with two stops coated in resilient material, schematically indicated by 53, 55, the first one fixed to the side 31 and the second one supported by the member 41 itself, for the purposes described herein.

Figure 5:
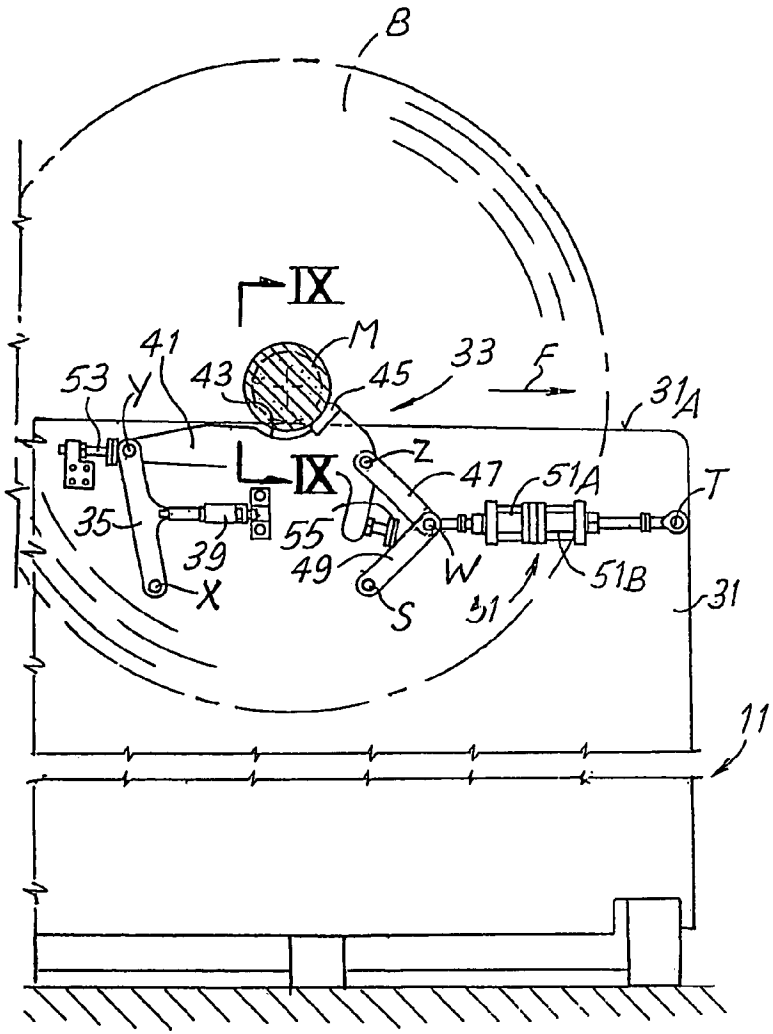

Operation of the mechanism illustrated is as follows. When the carriage 11 is in station 7 (position of the carriage 11A in FIG. 1), and after the finished mandrel has been unloaded, the mechanism positions itself as shown in FIG. 5, with the cylinder-piston system 51A retracted and the cylinder-piston-system 51B extended. The stop 45 formed by the seat 43 is above the rolling surface defined by the edge 31A. In this way, when a reel B is rolled with the mandrel M on which it is wound along the conveying guide 5, and the portions 5A lowered, on the tracks 31A, the ends of the mandrel M knock against the stops 45. The actuator 51 is locked in its position and thus constitutes a rigid system, the unit consisting of two hydraulic cylinder-piston systems. The axis W and the lever 49 therefore remain at a standstill. Due to the impact of the reel and the mandrel, the member 41 moves from left to right causing clockwise oscillation of the lever 35 and lever 47 around the axis W. Due to the angle of the levers 35 and 47, which are positioned in the direction from which the reel comes, i.e. towards the left (in an anti-clockwise direction) with respect to a vertical position, the thrust from left to right exerted on the member 41 by the reel due to its kinetic energy causes the member 41 and therefore the seat 43 to be raised. This lifting movement tends to raise the reel itself and therefore brake it.

Substantially, the kinetic energy of the reel which is rolled by the conveying guide 5 on the rolling tracks 31A is partly dispersed by the impact against the stop 45 and dissipated by the shock absorber 39, and for the most part transformed into potential energy, due to lifting of the reel obtained by clockwise oscillation of the levers 35 and 47.

Figure 6:
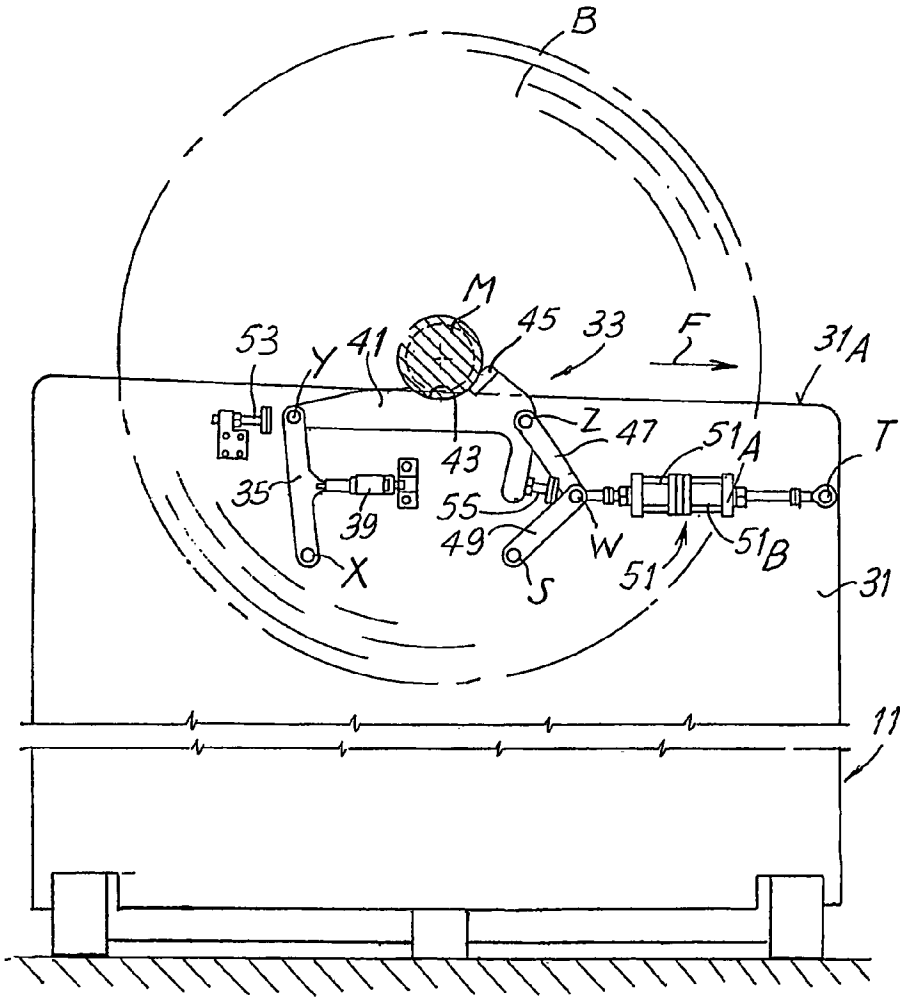
FIGS. 5, 6, 7 and 8 show a sequence of schematic lateral views to illustrate operation of the means for locking and releasing the mandrels on the carriage.

FIG. 6 shows the slightly raised position, with respect to the rolling tracks 31A, of the mandrel M, at the end of braking.

Figure 7:
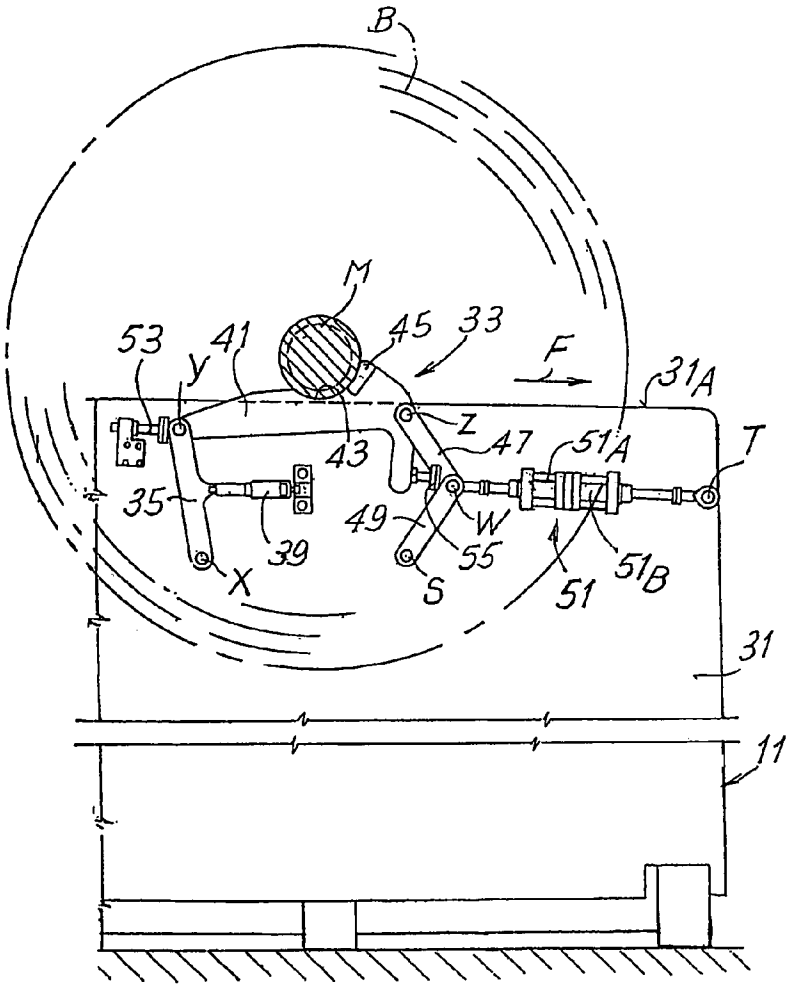

Subsequently, the cylinder-piston system 51B is extended and thus causes further lifting of the member 41 by opening of the toggle 47, 49, positioning the seat 43 formed by the member 41 as illustrated in FIG. 7. In this position the end of the mandrel is raised from the respective rolling track 31A, so that it remains substantially blocked in the arched seat 43 formed in the member 41. This position of the member 41 is maintained for as long as the mandrel and the respective reel B have to remain securely connected to the carriage 11. Substantially, the position is maintained until, the reel B in the unwinder 9 having finished, the mandrel is conveyed back to the station 7 by the carriage 11. This locking position is defined by the stops 53 and 55. In fact, the actuator 51 extends until the lever 35 is blocked against the stop 53 and the toggle 47, 49 against the stop 55.

Unloading of the mandrel from the carriage 11 is performed again by gravity and rolling of the mandrel M on the rolling tracks 31A formed by the sides 31 of the carriage. For said purpose the actuator 51 retracts, switching from the position of FIG. 7 to the position of FIG. 8, in which the seat 43 with the stop 45 move away below the rolling surface defined by the tracks 31A. The mandrel M can thus resume rolling on the slanting surface from left to right towards the position in which the operator on the platform 25 performs cleaning of the mandrel.

The device described with reference to FIGS. 5 to 9 is particularly effective as it acts as a brake for the reels and as a locking system for the reels and mandrels on the carriage, in addition to unloading the empty mandrels from the carriage.

Figure 3:
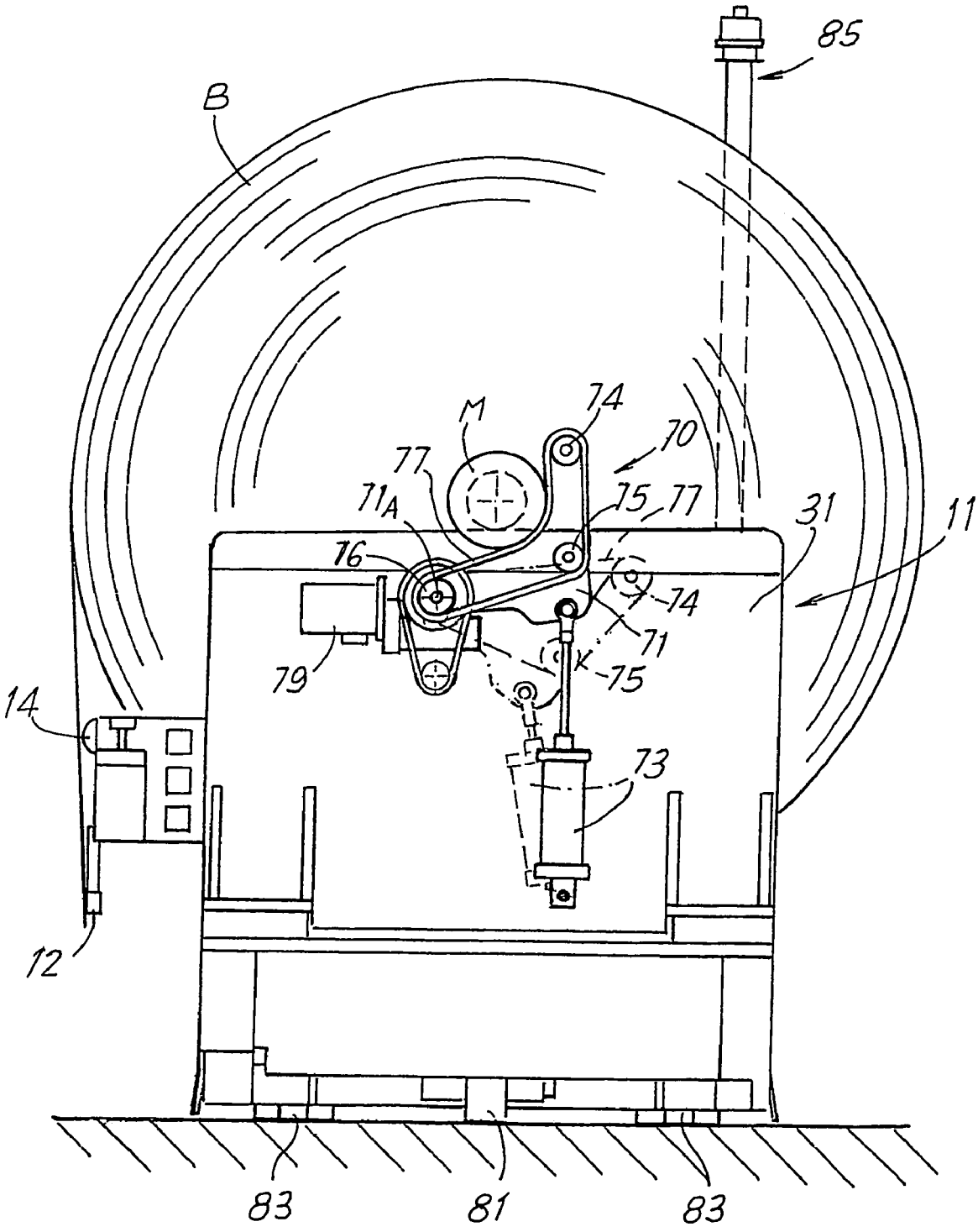
FIG. 3 shows a schematic section according to III-III of FIG. 2.

Each carriage is furthermore provided with an angle positioning device which permits rotation of the reel B supported on it, to position it at the right angle for preparing the free initial edge of the web material or ply wound on it. This device is illustrated in FIGS. 3 and 4, from which the details of the mandrel braking, locking and unloading mechanism are omitted. The angle positioning device, overall indicated by 70, comprises, on one of the two sides 31, an L-shaped oscillating arm 71 hinged around a horizontal axis 71A, parallel to the axis of the reel B supported by the carriage 11. The oscillation of the arm 71 between the two positions shown by a solid and broken line in FIG. 3 is controlled by a cylinder-piston actuator 73, connected in an intermediate position of the arm 71 and to the side 31.

The L-shaped oscillating arm 71 is provided with three pulleys 74, 75, 76 around which a belt 77 runs. The pulley 76 is driven by a gearmotor 79, rotation of which causes movement of the belt 77.

In the raised position of the arm 71, the belt 77 embraces the head MT of the end of the mandrel M which rests on the side supporting the device 70. Consequently, in this position the gearmotor 79 slowly rotates the mandrel M and the reel B wound on it. Rotation of the gearmotor 79 is controlled by the operator who must prepare the free initial edge of the reel so that it is ready for joining the end of the web material which is finishing in the unwinder to the material wound on said reel. This operation is performed, as mentioned previously, when the carriage 11 is in the position 11B (FIG. 1). Rotation of the reel is continued until the free edge of the material is in a suitable position to be gripped and retained on the suction bar 12 of the carriage (see in particular FIG. 3). Rotation of the reel by the gearmotor 79 can also be inverted to partially unwind the edge and facilitate the operation for positioning the edge on the bar 12.

When the reel B or the mandrel M have to roll freely along the tracks 31A, the oscillating arm 71 is set to the position shown in FIG. 3 by retraction of the actuator 73. The belt 77 also acts as a brake to prevent accidental rotation of the reel B when it is transferred by the carriage along its path towards the unwinder.

In FIGS. 3 and 4 the wheels of the carriage 11 can also be seen. It comprises a front pivoting, steering and drive wheel, indicated by 81, positioned at one end of the carriage 11. Two idle coaxial wheels 83 are arranged in an intermediate position. Said arrangement involves very modest radiuses of curvature and therefore allows the paths traced in the layout in FIG. 1 to be followed even when very little space is available for maneuvering the carriages. In the upper part of the carriage, on a purposely provided column, a receiver 85 is shown for a carriage guide laser beam, according to a per se known control technology.

It is understood that the drawing only shows a possible embodiment of the invention, which can vary in the forms and arrangements without departing from the scope of the concept underlying the invention. Any presence of reference numbers in the appended claims has the sole purpose of facilitating reading thereof in the light of the preceding description and the attached drawings and does not in any way limit the protective scope thereof.

The invention claimed is:

1. A plant for producing logs of web material, comprising in combination at least:

a winder which receives at least one web material and produces large diameter reels by winding said web material around winding mandrels;

at least one unwinder which unwinds said large diameter reels to provide unwound web material and which feeds the unwound web material to a converting line;

a plurality of carriages which transfer said large diameter reels with said mandrels from a loading station to said at least one unwinder, sustain said reels in the at least one unwinder during unwinding and convey the mandrels following unwinding to a predetermined area; and a transfer device for transferring the reels with said mandrels from the winder to said carriages, wherein said transfer device comprises a conveyor running between said winder and said loading station, and wherein said conveyor comprises a conveying guide for said reels.

2. The plant as claimed in claim 1, wherein said conveying guide supports the reels via protruding ends of the winding mandrels.

3. The plant as claimed in claim 2, wherein said conveyor further comprises moving parts which are positionable in a retracted position for inlet and outlet of the carriages to and from said loading station, and in an active position which permits transfer of the reels to said carriages positioned in the loading station.

4. The plant as claimed in claim 1, wherein said conveyor further comprises moving parts which are positionable in a retracted position for inlet and outlet of the carriages to and from said loading station, and in an active position which permits transfer of the reels to carriages positioned in the loading station.

5. The plant as claimed in claim 1, wherein a rolling track, on which said mandrels roll, is arranged to constitute an extension of the conveying guide for the reels in the loading station.

6. A plant for producing logs of web material, comprising in combination at least:

a winder which receives at least one web material and produces large diameter reels by winding said web material around winding mandrels;

at least one unwinder which unwinds said large diameter reels to provide unwound web material and which feeds the unwound web material to a converting line;

a plurality of carriages which transfer said large diameter reels with said mandrels from a loading station to said at least one unwinder, sustain said reels in the at least one unwinder during unwinding and convey the mandrels following unwinding to a predetermined area; and a transfer device for transferring the reels with said mandrels from the winder to said carriages, wherein said transfer device comprises a conveyor running between said winder and said loading station, and wherein said conveyor comprises moving parts which are positionable in a retracted position for inlet and outlet of the carriages to and from said loading station, and in an active position which permits transfer of the reels to said carriages positioned in the loading station.

7. A plant for producing logs of web material, comprising in combination at least:

a winder which receives at least one web material and produces large diameter reels by winding said web material around winding mandrels;

at least one unwinder which unwinds said large diameter reels to provide unwound web material and which feeds the unwound web material to a converting line;

a plurality of carriages which transfer said large diameter reels with said mandrels from a loading station to said at least one unwinder, sustain said reels in the at least one unwinder during unwinding and convey the mandrels following unwinding to a predetermined area; and a continuous paper machine for producing said web material, said web material including at least one ply of paper, said continuous paper machine being arranged in relation to said winder to feed said web material from said continuous paper machine to said winder.

8. The plant as claimed in claim 7, further comprising a transfer device for transferring the reels with said mandrels from the winder to said carriages.

9. The plant as claimed in claim 8, wherein said transfer device comprises a conveyor running between said winder and said loading station.

10. A plant for producing logs of web material, comprising in combination at least:

a winder which receives at least one web material and produces large diameter reels by winding said web material around winding mandrels;

at least one unwinder which unwinds said large diameter reels to provide unwound web material and which feeds the unwound web material to a converting line;

a plurality of carriages which transfer said large diameter reels with said mandrels from a loading station to said at least one unwinder, sustain said reels in the at least one unwinder during unwinding and convey the mandrels following unwinding to a predetermined area, wherein said unwinder comprises two stations for two of said carriages, and wherein between the loading station and the unwinder a mechanism is present which is constructed and arranged to rotate said carriages approximately 180° around a substantially vertical axis before inserting the carriages in the unwinder, the two of said carriages being simultaneously present in the unwinder and being rotated approximately 180° with respect to each other.

11. The plant as claimed in claim 10, further comprising a transfer device for transferring the reels with said mandrels from the winder to said carriages.

12. The plant as claimed in claim 11 wherein said transfer device comprises a conveyor running between said winder and said loading station.

13. A plant for producing logs of web material, comprising in combination at least:

a winder which receives at least one web material and produces large diameter reels by winding said web material around winding mandrels;

at least one unwinder which unwinds said large diameter reels to provide unwound web material and which feeds the unwound web material to a converting line;

a plurality of carriages which transfer said large diameter reels with said mandrels from a loading station to said at least one unwinder, sustain said reels in the at least one unwinder during unwinding and convey the mandrels following unwinding to a predetermined area, wherein said carriages comprise a locking device for locking the mandrels on which said web material is wound, and wherein said locking device is combined with a rolling track on which said mandrels roll, the locking device retaining the mandrels in a predetermined position along said rolling track.

14. The plant as claimed in claim 13, wherein said rolling track slants with respect to horizontal, to permit rolling by gravity of the mandrels along the track.

15. The plant as claimed in claim 13, wherein said locking device comprises, for each end of the mandrels, a lever mechanism defining a seat for housing and retaining a corresponding end of a respective one of the mandrels, and a first actuator to lock and release the mandrels by said lever mechanism.

16. The plant as claimed in claim 15, wherein said lever mechanism comprises a member defining said seat, sustained by an oscillating lever and a pair of levers hinged together.

17. The plant as claimed in claim 16, wherein said pair of levers is combined with a second actuator which causes opening and closing of the pair of levers, said opening and closing causing oscillation of said oscillating lever and an oscillation movement, or a translation movement, or an oscillation and translation movement, of the member defining the seat for housing and retaining the end of the respective one of the mandrels, to perform functions of receiving the reels, lifting the reels from the rolling track and lowering the seat below the rolling track to permit unloading of the mandrels.

18. The plant as claimed in claim 17, wherein said second actuator is a cylinder-piston actuator.

19. The plant as claimed in claim 17, wherein said second actuator comprises a twin cylinder-piston system.

20. The plant as claimed in claim 19, wherein said oscillating lever is combined with a shock absorber.

21. The plant as claimed in claim 20, wherein an elastic member parallel to said shock absorber is combined therewith.

22. The plant as claimed in claim 16, wherein said oscillating lever and said pair of levers are arranged so that impact of one of said mandrels against said seat causes raising of the member defining the seat.

23. The plant as claimed in claim 13, further comprising a transfer device for transferring the reels with said mandrels from the winder to said carriages.

24. The plant as claimed in claim 23, wherein said transfer device comprises a conveyor running between said winder and said loading station.

25. The plant as claimed in claim 24, wherein said rolling track slants with respect to horizontal, to permit rolling by gravity of the mandrels along the track.

26. The plant as claimed in claim 24, wherein said locking device comprises, for each end of the mandrels, a lever mechanism defining a seat for housing and retaining a corresponding end of a respective one of the mandrels, and a first actuator to lock and release the mandrels by said lever mechanism.

27. The plant as claimed in claim 26, wherein said lever mechanism comprises a member defining said seat, sustained by an oscillating lever and a pair of levers hinged together.

28. The plant as claimed in claim 27, wherein said pair of levers is combined with a second actuator which causes opening and closing of the pair of levers, said opening and closing causing oscillation of said oscillating lever and an oscillation movement, or a translation movement, or an oscillation and translation movement, of the member defining the seat for housing and retaining the end of the respective one of the mandrels, to perform functions of receiving the reels, lifting the reels from the rolling track and lowering the seat below the rolling track to permit unloading of the mandrels.

29. The plant as claimed in claim 28, wherein said second actuator is a cylinder-piston actuator.

30. The plant as claimed in claim 28, wherein said second actuator comprises a twin cylinder-piston system.

31. The plant as claimed in claim 30, wherein said oscillating lever is combined with a shock absorber.

32. The plant as claimed in claim 31, wherein an elastic member parallel to said shock absorber is combined therewith.

33. The plant as claimed in claim 27, wherein said oscillating lever and said pair of levers are arranged so that impact of one of said mandrels against said seat causes raising of the member defining the seat.

34. The plant as claimed in claim 23, wherein said rolling track slants with respect to horizontal, to permit rolling by gravity of the mandrels along the track.

35. The plant as claimed in claim 23, wherein said locking device comprises, for each end of the mandrels, a lever mechanism defining a seat for housing and retaining a corresponding end of a respective one of the mandrels, and a first actuator to lock and release the mandrels by said lever mechanism.

36. The plant as claimed in claim 35, wherein said lever mechanism comprises a member defining said seat, sustained by an oscillating lever and a pair of levers hinged together.

37. The plant as claimed in claim 36, wherein said pair of levers is combined with a second actuator which causes opening and closing of the pair of levers, said opening and closing causing oscillation of said oscillating lever and an oscillation movement, or a translation movement, or an oscillation and translation movement, of the member defining the seat for housing and retaining the end of the respective one of the mandrels, to perform functions of receiving the reels, lifting the reels from the rolling track and lowering the seat below the rolling track to permit unloading of the mandrels.

38. The plant as claimed in claim 37, wherein said second actuator is a cylinder-piston actuator.

39. The plant as claimed in claim 37, wherein said second actuator comprises a twin cylinder-piston system.

40. The plant as claimed in claim 39, wherein said oscillating lever is combined with a shock absorber.

41. The plant as claimed in claim 40, wherein an elastic member parallel to said shock absorber is combined therewith.

42. The plant as claimed in claim 36, wherein said oscillating lever and said pair of levers are arranged so that impact of one of said mandrels against said seat causes raising of the member defining the seat.

* * * * *